US007922303B2

(12) United States Patent
Chikamoto

(10) Patent No.: US 7,922,303 B2
(45) Date of Patent: Apr. 12, 2011

(54) INK-JET HEAD

(75) Inventor: Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 702 days.

(21) Appl. No.: 11/864,577

(22) Filed: Sep. 28, 2007

(65) Prior Publication Data

US 2008/0079775 A1 Apr. 3, 2008

(30) Foreign Application Priority Data

Sep. 29, 2006 (JP) ..... 2006-268471

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS

| | | | | |
|---|---|---|---|---|
| 6,361,155 | B1 * | 3/2002 | Kanda et al. | 347/70 |
| 6,536,879 | B2 | 3/2003 | Ito et al. | |
| 2005/0040581 | A1 | 2/2005 | Ito | |
| 2006/0132551 | A1 | 6/2006 | Chikamoto | |

FOREIGN PATENT DOCUMENTS

| | | | |
|---|---|---|---|
| JP | 2001-063052 | A | 3/2001 |
| JP | 2002096477 | A | 4/2002 |
| JP | 2003-104583 | A | 4/2003 |
| JP | 2005-040990 | A | 2/2005 |
| JP | 2006-175683 | A | 7/2006 |

OTHER PUBLICATIONS

Japanese Patent Office, Notice of Reasons for Rejection for Japanese Patent Application No. 2006-268471 (counterpart to above-captioned patent application), mailed Aug. 19, 2008.

* cited by examiner

*Primary Examiner* — Manish S Shah
*Assistant Examiner* — Alexander C Witkowski
(74) *Attorney, Agent, or Firm* — Baker Botts L.L.P.

(57) ABSTRACT

An ink-jet head has a flow channel unit having a number of laminated plates, including a first, second, and third plate, which together form a common ink chamber, nozzles, and pressure chambers. The first plate has apertures which place the common ink chambers in fluid communication with the pressure chambers, and also has first recesses extending away from the second plate, and second recesses extending toward the third plate. The surface of the third plate has recesses extending away from the first plate. An opposite surface of the first plate has a number of openings which place the first and second recesses in fluid communication with the third recesses of the third plate. In another ink-jet head, a surface of the second plate has recesses extending away from the first plate, a portion of which are configured to be in fluid communication with recesses on the first plate.

13 Claims, 11 Drawing Sheets

INK-JET HEAD

BACKGROUND OF THE INVENTION

1. Field of the Invention

The present invention relates to an ink-jet head that discharges ink on a recording medium.

2. Description of the Related Art

A known ink-jet head includes a cavity plate formed of five plates piled and bonded together with adhesive agent, and a piezoelectric actuator bonded to the cavity plate. A base plate included in the cavity plate the ink-jet head includes pressure chambers, distal end flow channels formed at one end of the respective pressure chambers, opposite end flow channels formed at the other ends of the respective pressure chambers, and elongated portions serving as ink flow channels for placing the pressure chamber and the opposite end flow channels in fluid communication. The base plate includes opposing release grooves formed between the elongated portions, and substantially arcuate-shaped release grooves surrounding a side edge of each of the opposite end flow channels. The opposing release grooves are in fluid communication via release holes which penetrate through the base plate.

In a known configuration, when the base plate and a spacer plate adjacent to the base plate are bonded with adhesive agent, excessive adhesive agent is attracted toward the release grooves having a small cross-sectional area and hence generating capillary force larger than the portions having a large cross-sectional area. In a known ink-jet head, when the pressure chambers are arranged at a higher density, the distances between the pressure chambers, between the distal end flow channels, and between the opposite end flow channels are reduced. When the distance between the opposite end flow channels is reduced, it may become difficult to rest the release grooves formed between the opposite end flow channels on the base plate while leaving a bonding margin for connecting the opposite end flow channels and through holes formed through the spacer plate. Then, the release grooves formed between the squeezed portions may not connect to the arcuate-shaped release grooves. When the release grooves are isolated, air in the release grooves may be trapped when the base plate and the spacer plate are bonded with the adhesive agent, and the excessive adhesive agent may be attracted toward the squeezed portions where air tends to be released, and the excessive adhesive agent may clog the elongated portions.

SUMMARY OF THE INVENTION

An embodiment of the invention describes an ink-jet head comprising a flow channel unit, the flow channel unit comprising a plurality of laminated plates comprising a first plate, a second plate, and a third plate, wherein the plurality of laminated plates is configured to form a common ink chamber therethrough, and a plurality of individual ink flow channels, each individual ink flow channel configured to extend from the common ink chamber to one of the plurality of nozzles via one of the plurality of pressure chambers.

The first plate comprises a plurality of apertures configured to place the common ink chamber and the pressure chambers in fluid communication, and a surface of the first plate adjacent to the second plate has a plurality of first recesses extending away from the second plate. The first recesses are configured to be in fluid communication with the atmosphere, and a plurality of second recesses extending toward the third plate, and the second recesses being surrounded by the plurality of apertures. A surface of the third plate has a plurality of third recesses extending away from the first plate, and an opposite surface of the first plate has a plurality of openings therethrough. The plurality of openings is configured to place the first and second recesses in fluid communication with the third recesses of the third plate.

Another embodiment of the invention describes an ink-jet head comprising a flow channel unit, the flow channel unit, the flow channel unit comprising a plurality of laminated plates comprising a first plate and a second plate, wherein the plurality of laminated plates is configured to form a common ink chamber, a plurality of nozzles, and a plurality of pressure chambers therethrough, and a plurality of individual ink flow channels, each individual ink flow channel configured to extend from the common ink chamber to one of the plurality of nozzles via one of the plurality of pressure chambers. The first plate comprises a plurality of apertures configured to place the common ink chambers and the pressure chambers in fluid communication, and a surface of the first plate adjacent to the second plate comprises a plurality of first recesses extending away from the second plate. The first recesses are configured to be in fluid communication with the atmosphere, and a plurality of second recesses extending away from the second plate, and the second recesses are surrounded by the plurality of apertures. A surface of the second plate comprises a plurality of third recesses extending away from the first plate, each of the plurality of third recesses opposing a portion of one of the plurality of first recesses and a portion of one of the plurality of fourth recesses. The third recesses are configured to be in fluid communication with the respective portions of each of the plurality of first and second recesses.

Further embodiments according to the invention are subject-matter of the dependent claims, respectively.

DESCRIPTION OF THE PREFERRED EMBODIMENTS

Embodiments of the present invention, and their features and advantages, are understood by referring to FIGS. 1-11, like numerals being used for like or corresponding parts in the various drawings.

Figure 1:
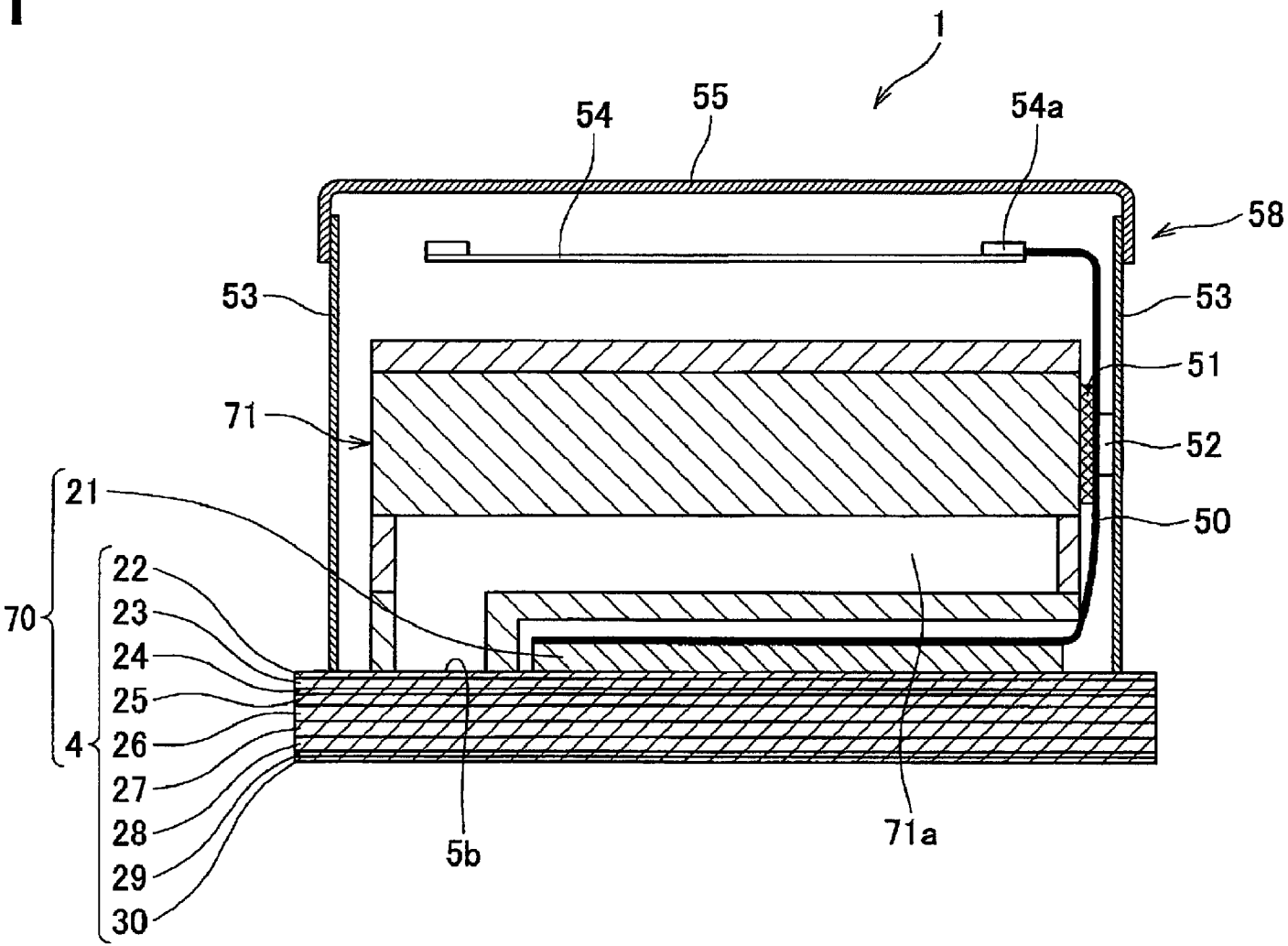
FIG. 1 is a vertical cross-sectional view of an ink-jet head according to an embodiment of the invention.

As shown in FIG. 1, an ink-jet head 1 may include a head body 70 for discharging ink, a reservoir unit 71, which may be arranged on the upper surface of head body 70, a flexible printed circuit (FPC) 50 electrically connected to the head body 70, and a control board 54 electrically connected to FPC 50. Head body 70 may include a flow channel unit 4 formed with an ink flow channel in the interior thereof, and an actuator unit 21. FPC 50 may be provided with a driver IC 52 configured to supply drive signals. Driver IC 52 may be mounted substantially at the middle of FPC 50, and may be connected to the upper surface of actuator 21.

Figure 2:
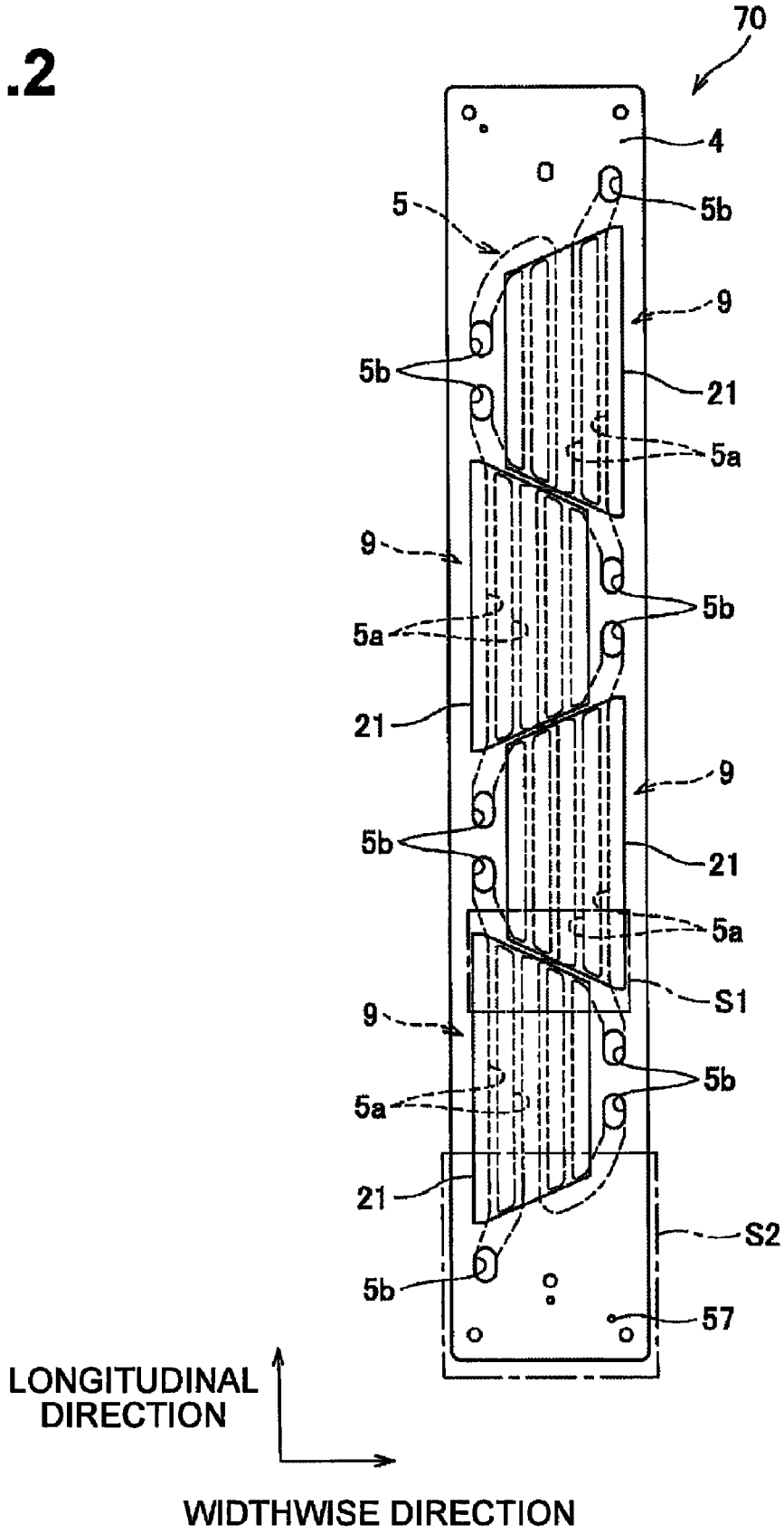
FIG. 2 is a plan view of a head body as shown in FIG. 1.

Head body 70 may be configured so that actuator unit 21 may be arranged on the upper surface of flow channel unit 4. As shown in FIG. 2, a plurality of, e.g., ten ink supply ports 5*b* may be in fluid communication with the ink flow channels in the interior of flow channel unit 4, and may be formed on the upper surface of the flow channel unit 4. As described in more detail herein, the ink flow channels may include pressure chambers 10 formed on the upper surface of flow channel unit 4, and ink discharge nozzles 8 in fluid communication with pressure chambers 10.

Control board 54 may be arranged substantially horizontally above reservoir unit 71, and the other end of FPC 50 may be connected thereto, via a connector 54*a*. Driver IC 52 may be adapted to supply drive signals to actuator unit 21 via a wiring line, e.g., a signal line, of the FPC 50 on the basis of the command from control board 54. Reservoir unit 71 may include an ink reservoir 71*a* for storing ink therein, and ink reservoir 71*a* may be in fluid communication with ink supply port 5*b* of flow channel unit 4. Ink in ink reservoir 71*a* may be supplied to the ink flow channels in flow channel unit 4 via ink supply ports 5*b*.

Actuator unit 21, reservoir unit 71, control board 54, and FPC 50 may be covered by a cover member 58. Cover member 58 may include a side cover 53, and a head cover 55, and may be positioned to prevent entry of ink or ink mist present around the exterior of cover member 58. Cover member 58 may be formed of any suitable metallic material. Reservoir unit 71 may be provided with a sponge 51, having resilience on a side surface thereof Driver IC 52 on FPC 50 may be mounted so as to oppose sponge 51, and driver IC 52 may be pressed against the inner surface of side cover 53 by sponge 51. Heat generated in the driver IC 52 may be transmitted to head cover 55 via side cover 53, and may be discharged to the atmosphere via metallic cover member 58.

Flow channel unit 4 of head body 70 may be formed with a number of pressure chambers 10 and a number of nozzles 8 being in fluid communication with a number of pressure chambers 10. The respective pressure chambers 10 may have a substantially diamond shape, having portions at an acute angle at both longitudinal ends, and also having portions at an obtuse angle at both widthwise ends, e.g., a parallelogram with rounded corners. A plurality of pressure chambers 10 may be arranged adjacently on the upper surface of flow channel unit 4 in two directions, e.g., in the direction of arrangement A and in the direction of arrangement B, in a matrix pattern. The direction of arrangement A may be a longitudinal direction of flow channel unit 4, and may extend in parallel to a shorter diagonal line of pressure chamber 10. The direction of arrangement B may correspond to the direction of one oblique line of pressure chamber 10, forming an obtuse angle θ with respect to the direction of arrangement A.

Pressure chambers 10 may be arranged in a matrix pattern in the directions of arrangement A and in the direction of arrangement B. Along the direction of arrangement A, pressure chambers 10 may be spaced apart from each other at a distance which corresponds to an output print resolution of 37.5 Dots Per Inch (DPI). A plurality of, e.g., sixteen, pressure chambers 10 may be arranged in the direction of arrangement B in an ink discharge area, described in more detail herein. The plurality of pressure chambers 10 may be grouped in a pressure chamber group 9, as shown in FIG. 2. Furthermore, a plurality of, e.g., four, actuator units 21 may be bonded to the upper surface of flow channel unit 4. The plurality of actuator units may be arranged into two offset, zigzagging rows, corresponding to the arrangement of pressure chamber group 9. Pressure chamber groups 9 and actuator units 21 each may have a trapezoidal outline shape, as shown in FIG. 2.

Figure 3:
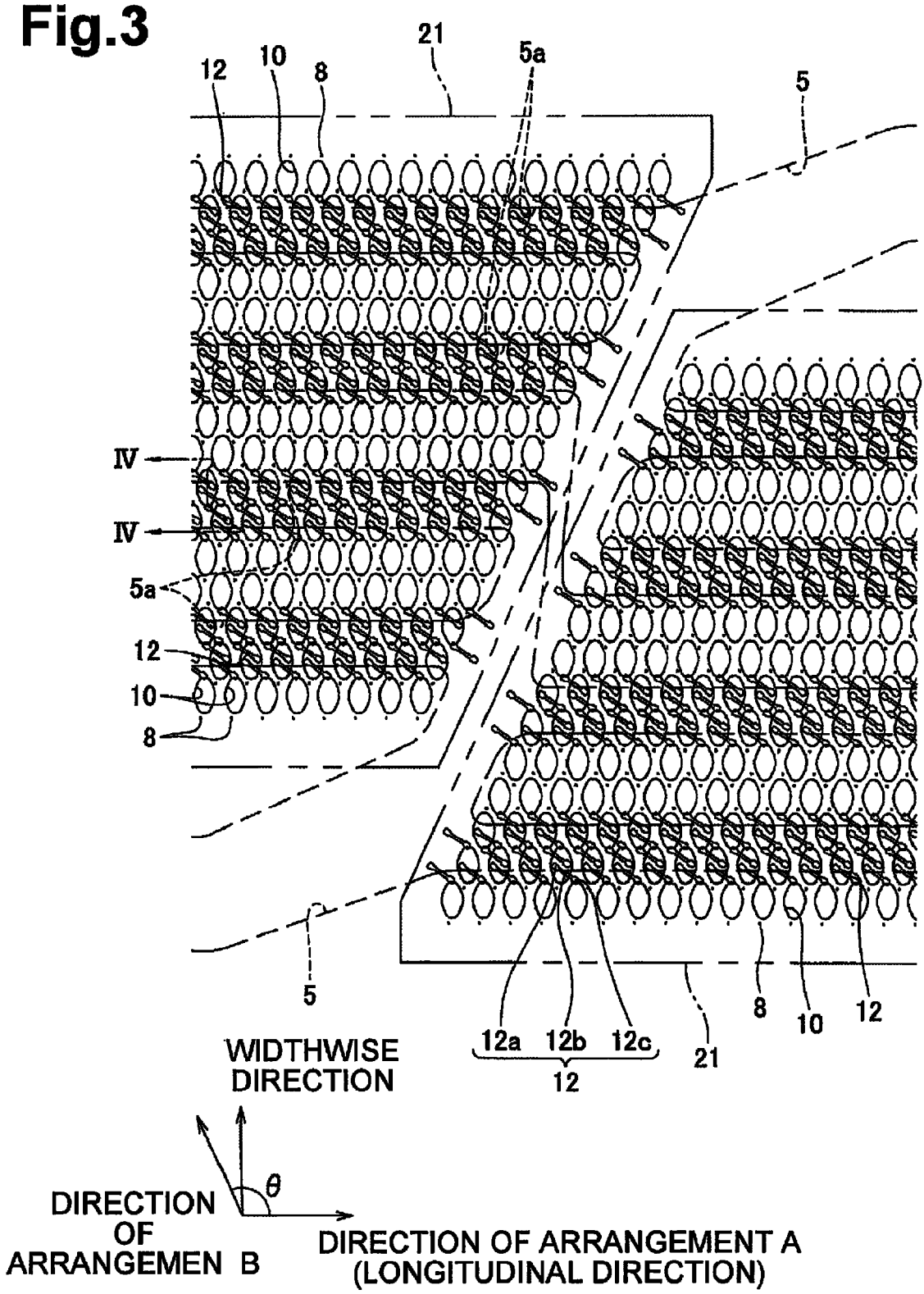
FIG. 3 is an enlarged view of an area S1 surrounded by a dashed line shown in FIG. 2.

The lower surface of flow channel unit 4, which may oppose the bonding area of actuator unit 21, may corresponds to an ink discharge area, including a number of nozzles 8 arranged therein. Nozzles 8 also may be arranged in a matrix pattern and constitute a plurality of nozzle rows. As shown in FIG. 3, in an embodiment, a plurality of, e.g., sixteen rows of the pressure chambers 10 may be arranged in a longitudinal direction of flow channel unit 4, and may be arranged equidistantly and parallel to each other, in the widthwise direction of flow channel unit 4. The number of pressure chambers 10 located in each pressure chamber row decreases gradually from the long side to the short side of pressure chamber group 9, corresponding to the outline shape of actuator unit 21. Nozzles 8 may be arranged in the same manner as the pressure chamber 10. Accordingly, image formation at a specific resolution, e.g., 600 dpi, may be achieved.

In order to facilitate comprehension of the drawings, FIG. 3 represents actuator units 21 with double dashed chain lines, and pressure chambers 10 and apertures 12, which normally would appear with broken lines, since they may be located below actuator units 21, are drawn in solid lines. As shown in FIG. 2 and FIG. 3, manifold flow channels 5 may continue to ink supply ports 5*b*, and common ink chambers, e.g., sub-manifold flow channels 5*a*, branched from the manifold flow channels 5, may be formed in flow channel unit 4. Manifold flow channels 5 may extend along the oblique sides of the actuator units 21. In an area interposed between two actuator units 21, one manifold flow channel 5 may be used by both adjacent actuator units 21, and sub-manifold flow channels 5*a* may be branched from both sides of manifold flow channel 5. Sub-manifold flow channels 5*a* may extend in the longitudinal direction of flow channel unit 4. A plurality of nozzles 8 may be arranged in the longitudinal direction of flow channel unit 4, as shown in FIG. 3. Respective nozzles 8 may be in fluid communication with pressure chambers 10, and with sub-manifold flow channels 5*a*, via holes or squeezed flow channels, e.g., apertures 12.

Figure 4:
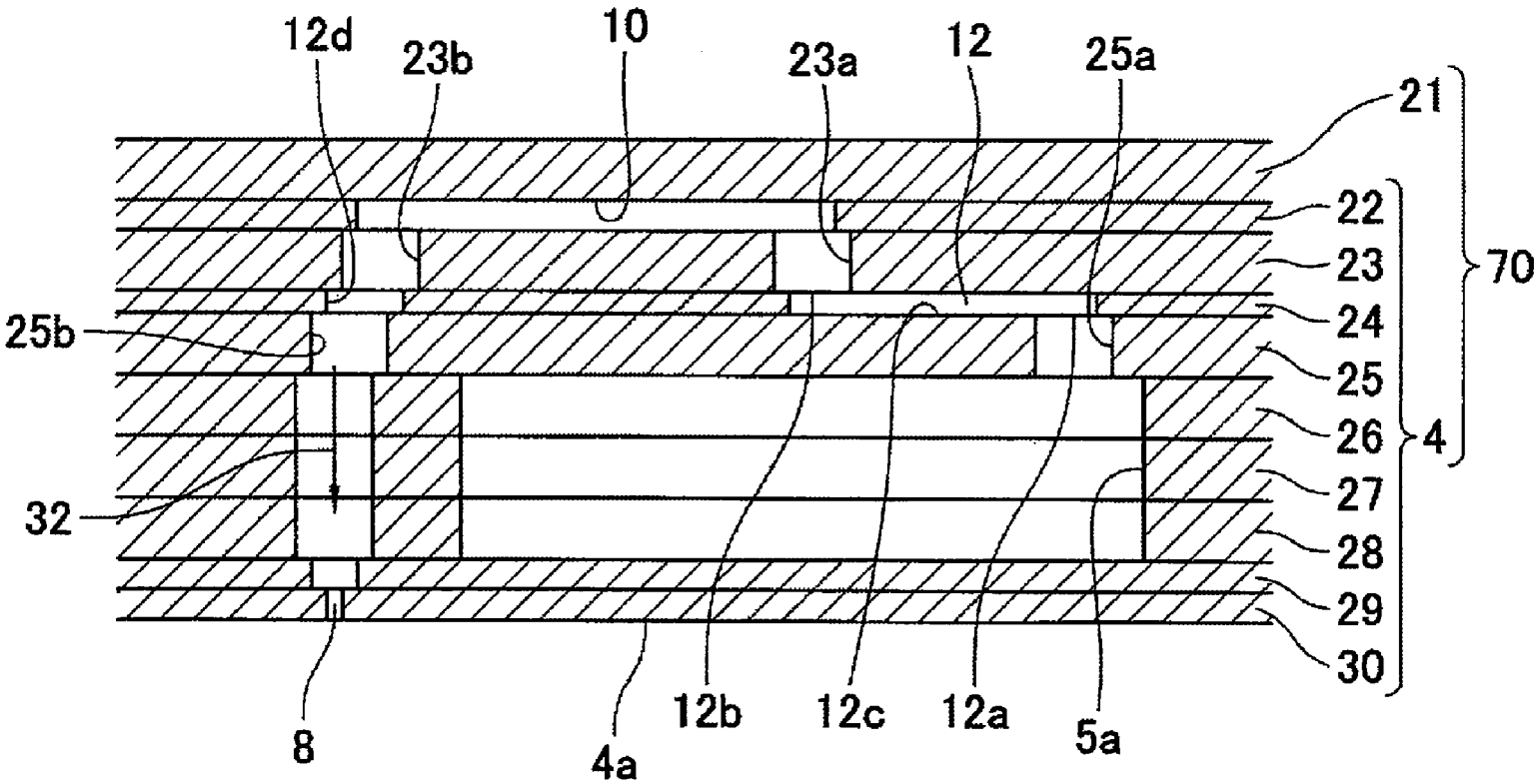
FIG. 4 is a cross-sectional view taken along the line IV-IV in FIG. 3.

As shown in FIG. 4, head body 70 may be formed by bonding flow channel unit 4 and actuator unit 21. Flow channel unit 4 may have a laminated structure in which a plurality of, e.g., nine, metal plates may be laminated together. The plurality of metal plates may include, in order from top to bottom, a cavity plate 22, a base plate, e.g., a third plate 23, an aperture plate, e.g., a first plate 24, a supply plate, e.g., a second plate 25, manifold plates 26, 27, and 28, a cover plate 29, and a nozzle plate 30.

Cavity plate 22 may comprise any known metal, and may have a number of openings having a substantially diamond shape. Each openings may correspond to location of a pressure chambers 10. Base plate 23 may comprise any known metal, and may have a communication openings 23*a* between pressure chamber 10 and aperture 12, and another communication hole 23*b* connecting pressure chamber 10 to nozzle 8, respectively corresponding to the one pressure chamber 10 of the cavity plate 22.

Aperture plate 24 may comprise any known metal, and, as shown in more detail in FIG. 3 and FIG. 7, may include aperture 12. Referring again to FIG. 4, aperture 12 may have a communicating portion 12*c* in fluid communication with an ink inlet port 12*a* on the side of the sub-manifold flow channel 5*a*, and an ink outlet port 12*b* on the side of pressure chamber 10. Aperture plate 24 also may include a communication hole 12*d*, narrower than communication portion 12*c*, placing pressure chamber 10 in fluid communication with nozzle 8. Supply plate 25 may comprise any known metal, and may have a communication hole 25*a* between aperture 12 and sub-manifold flow channel 5*a*, and another communication opening 25*b* from pressure chamber 10 to nozzle 8.

Manifold plates 26, 27, and 28 may comprise any known metal, and may include a communication opening from pressure chamber 10 to nozzle 8, respectively, corresponding to pressure chamber 10 of cavity plate 22, in addition to sub-manifold flow channels 5*a*. Cover plate 29 may comprise any known metal, and may include communication openings from pressure chambers 10 to nozzles 8, corresponding to pressure chamber 10 of cavity plate 22. Nozzle plate 30 may comprise any known metal, and may include nozzles 8, corresponding to pressure chamber 10 of cavity plate 22.

Figure 5:
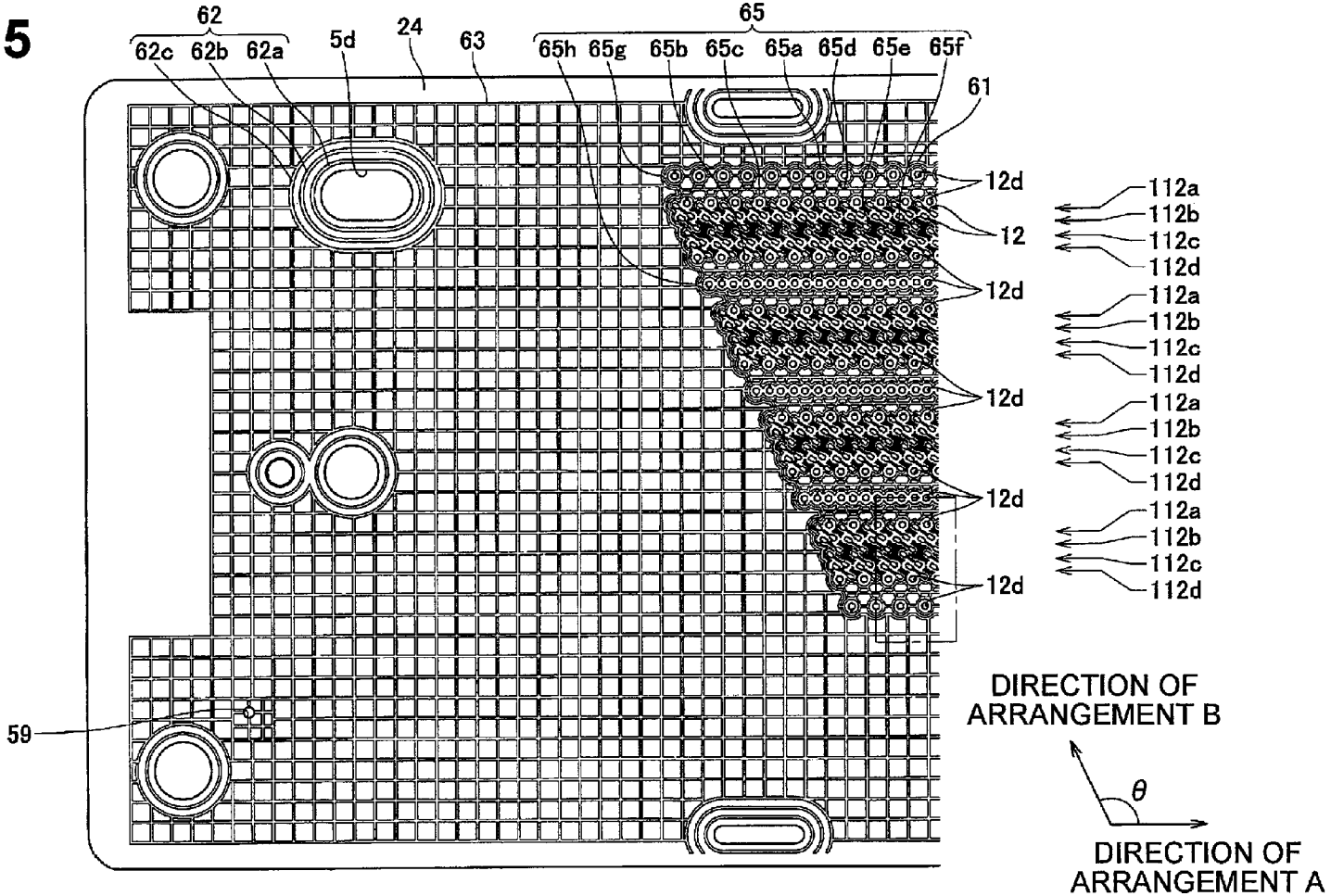
FIG. 5 is a partly enlarged view of an aperture plate in an area S2 surrounded by the dashed line shown in FIG. 2.
Figure 6:
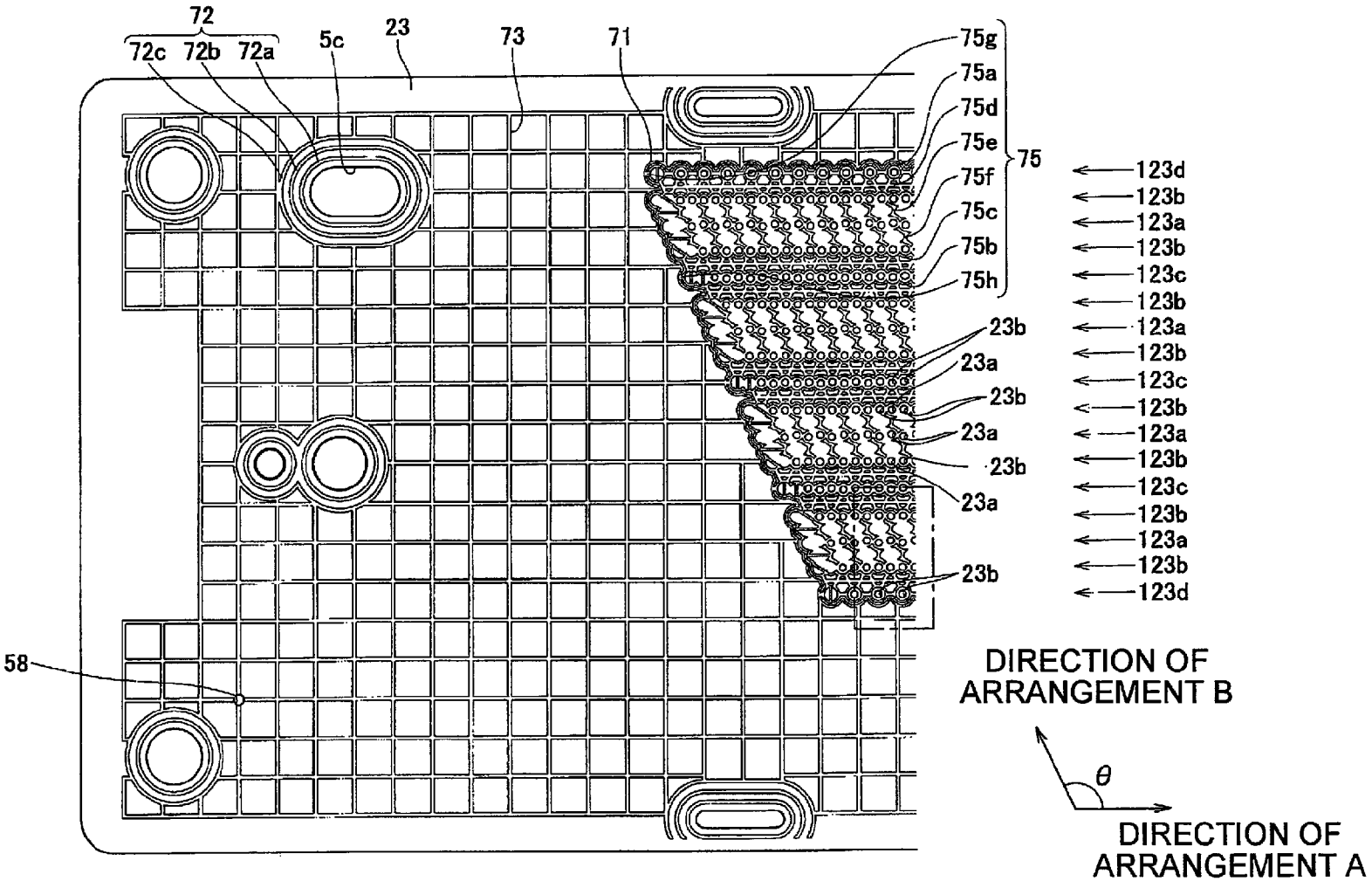
FIG. 6 is a partly enlarged view of a base plate in an area S2 surrounded by the dashed line shown in FIG. 2.

As shown in FIG. 5 and FIG. 6, base plate 23, aperture plate 24, and supply plate 25 each may be formed with openings 5*c* and 5*d* for ink supply port 5*b* and manifold flow channel 5. Referring again to FIG. 4, nine plates 22 to 30 may be aligned with each other and laminated so that an individual ink flow channels 32 may be formed, as shown in FIG. 4. Individual ink flow channel 32 may extend from the exit of sub-manifold flow channel 5*a* upward, extend horizontally in aperture 12, then extends further upward and horizontally again in pressure chamber 10, then extend obliquely downward in a direction away from aperture 12, and finally extend vertically downward toward nozzle 8. The opening which corresponds to pressure chamber 10 formed on cavity plate 22 may be closed partly by base plate 23, so that an opening of pressure chamber 10 formed as a recess may be formed on the upper surface of flow channel unit 4. Then, the actuator unit 21 may be bonded to the upper surface of flow channel unit 21, so as to close the opening of pressure chamber 10.

As shown in FIG. 4, pressure chamber 10 and aperture 12 may be provided at different levels. Referring again to FIG. 3, aperture 12, which may be in fluid communication with one pressure chamber 10, may be arranged at the same position as another pressure chamber 10, adjacent to the pressure chamber shown in plan view in flow channel unit 4, corresponding to the ink discharge area located below actuator unit 21. Pressure chambers 10 may be arranged closely to each other at a high density, which may allow ink-jet head 1 to perform image printing at a high resolution, while maintaining a minimal occupancy area.

As shown in FIG. 5, a plurality of apertures 12 and communication holes 12*d* may be formed in areas which overlap actuator units 21, similarly to the overlapping of the plurality of pressure chamber 10. Also similarly to pressure chambers 10, apertures 12 may be arranged adjacent to each other in a matrix pattern, in the direction of arrangement A, and the direction of arrangement B. A plurality of, e.g., sixteen, apertures 12 may be included in the direction of arrangement B. Nevertheless, the arrangement of communication holes 12*d* may be slightly different. Although communication holes 12*d* may be adjacently arranged in the direction of arrangement A and the direction of arrangement B in a matrix pattern. A set of two rows, each raw including eight communication holes 12*d*, may correspond to sixteen pressure chambers 10, arranged in the direction of arrangement B.

As shown in FIG. 5, the plurality of apertures 12 may be divided into a plurality of, e.g., four, aperture rows 112*a* to 112*d*, arranged along the direction of arrangement A. Aperture rows 112*a* to 112*d* may be repeatedly arranged from one end to the other end of aperture plate 24 in either direction orthogonal to the direction of arrangement A of aperture plate 24. As shown in FIG. 7B, ink outlet ports 12*b* of apertures 12 may be arranged on the right side in aperture rows 112*b* and 112*d*, and on the left side in aperture rows 112*a* and 112*c*. Ink inlet ports 12*a* of apertures 12 may be located on the opposite sides of ink outlet ports 12*b* of apertures 12, in the respective aperture rows 112*a* to 112*d*.

Communicating portions 12*c*, located between ink inlet ports 12*a* and ink outlet ports 12*b* of apertures 12, may have a smaller short-side width than the widths of ink inlet ports 12*a* and ink outlet ports 12*b*, when viewed in plan view. Communicating portions 12*c* also may be formed to be the smallest in cross-sectional area for ink passage in individual ink flow channel 32, so that the resistance of the ink flow channel between sub-manifold flow channels 5*a* to pressure chambers 10 may be regulated. As shown in FIG. 5, along the outermost periphery of the plurality of apertures 12 and communication holes 12*d*, on the surface of the aperture plate 24 on the side of the supply plate 25, a surrounding groove 61 having a shape corresponding thereto may be formed.

An opening surrounding groove 62 may be formed on the outer periphery of each opening 5*d* of aperture plate 24, and conforming to the outer peripheral shape of opening 5*d*, and having a bonding margin of a predetermined width. Opening surrounding groove 62 may include opening surrounding groove 62*a* at a position closest to opening 5*d*, and opening surrounding grooves 62*b* and 62*c* may be enlarged from secondary opening surrounding groove 62*a*, in sequence. Connecting grooves 63 may be formed into a lattice pattern, and connected to surrounding groove 61. Opening surrounding grooves 62*c* may be formed over the entire surface of aperture plate 24, on the side of the supply plate 25, except for the areas inside the surrounding groove 61 and inside opening surrounding groove 62. Aperture plate 24 may be formed with a through hole 59, located at a lower left position when aperture plate is positioned.

Through hole 59 and connecting groove 63 may be in fluid communication with each other. Similarly, through holes 57 and 58 may be formed on cavity plate 22 and base plate 23, at similar positions to that of through hole 59 on aperture plate 24. Through holes 57, 58, and 59 may be positioned so that they are in fluid communication with each other when the respective plates are laminated on top of each other. Accordingly, the surrounding groove 61, the opening surrounding groove 62*c*, and the connecting groove 63 may be in fluid communication with the atmosphere.

Figure 7A:
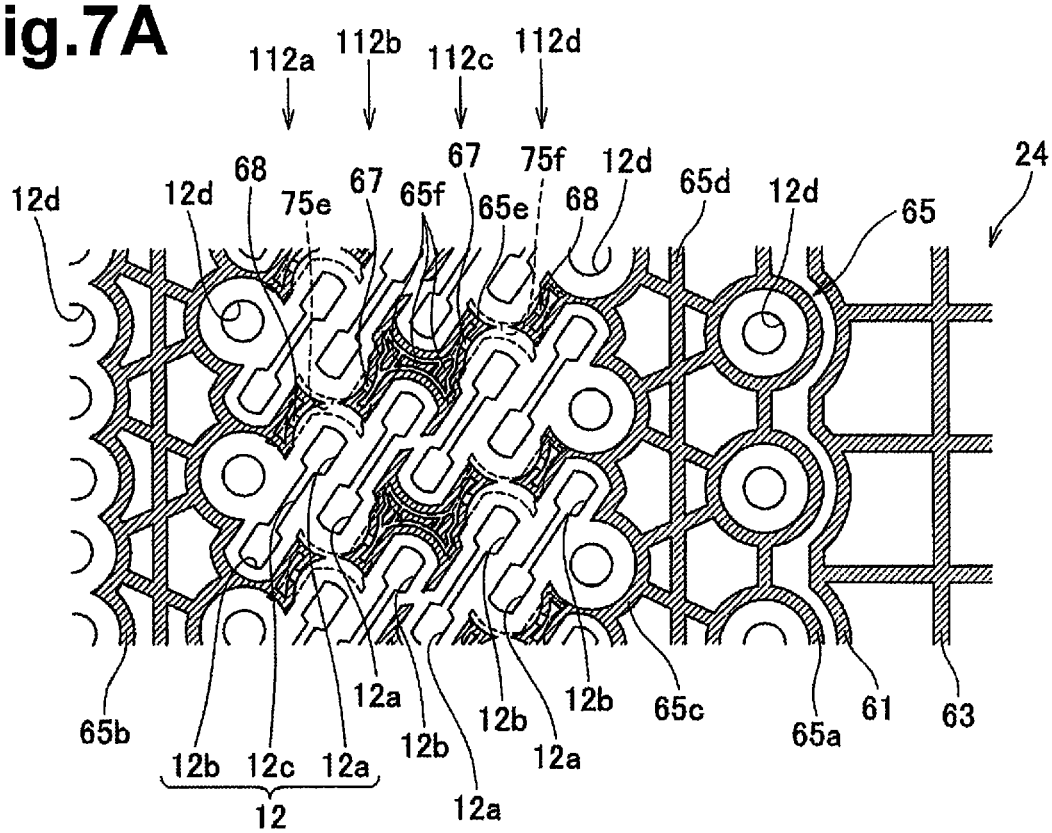
FIG. 7A is a partly enlarged view showing an area surrounded by a dashed line shown in FIG. 5.
Figure 7B:
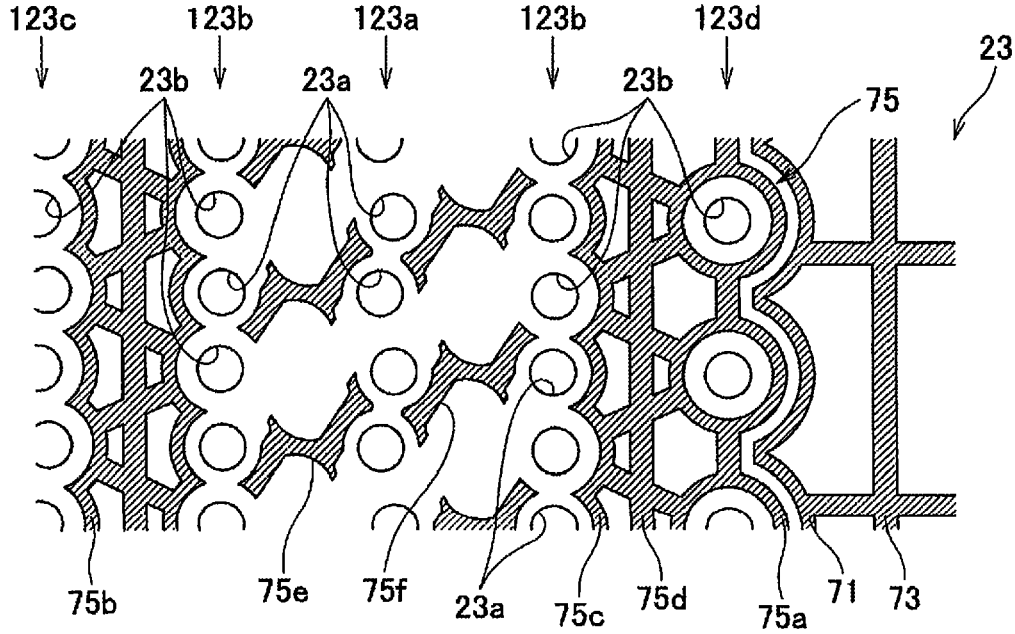
FIG. 7B is a partly enlarged view showing an area surrounded by a dashed line shown in FIG. 6.

As shown in FIG. 5 and FIG. 7A, an inner groove 65 may be formed inside surrounding groove 61. Inner groove 65 may include a groove 65*a*, and groove 65*a* may extend along the outer peripheral shapes of the respective communication holes 12*d*. Inner groove 65 also may include a groove 65*b* surrounding the plurality of adjacent communication holes 12*d*, a first recess, e.g., a groove 65*c*, surrounding the apertures 12, apertures 12 constituting four adjacent aperture rows 112*a* to 112*d* and communication holes 12*d* adjacent to apertures 12. Inner groove 65 further may include a groove 65*d* for connecting 65*a*, groove 65*b*, and groove 65*c*, a second recess, e.g., a groove 65*e* formed at a position surrounded by the apertures 12, apertures 12 constituting four aperture rows 112*a* to 112*d*. Inner groove 65 also may include a groove 65*f* surrounded by the groove 65*e*, a connecting groove 65*g* formed outside communication holes 12*d*, located at the outermost position of the rows including the plurality of communication holes 12*d* for being in fluid communication with surrounding groove 61 and groove 65*a*, and a connecting groove 65*h* formed outside communication holes 12*d*, located at the outermost position of the rows including the plurality of communication holes 12*d*, for connecting the surrounding groove 61 and the groove 65*b*.

In this manner, in terms of aperture plate 24 by itself, grooves 65*a* to 65*d* of inner groove 65, may be connected to surrounding groove 61, and may be in fluid communication with the atmosphere via through hole 59. Grooves 61, 62, 63 and 65, which may be formed on aperture plate 24, may be formed as recesses opening toward supply plate 25, e.g., opening on a surface of aperture plate 24 on the side of the supply plate 25. Grooves 61, 62, 63, and 65 may be formed by a process, e.g., a half etching process, for releasing the excessive adhesive agent generated when aperture plate 24 and supply plate 25 are bonded.

As shown in FIG. 6, communication holes 23*a* and communication holes 23*b* may be arranged on base plate 23 in a matrix pattern in the directions of arrangement A and B, in a similar manner as the plurality of apertures 12. The plurality of communication holes 23*a* and 23*b*, arranged in a matrix pattern, may be divided into rows 123*a*, including the plurality of communication holes 23*a* arranged in the direction of arrangement A, rows 123*b*, arranged at positions interposing the rows 123*a* and including the plurality of communication holes 23*a* and the communication holes 23*b* arranged alternately along the direction of arrangement A, and rows 123*c* and 123*d*, arranged at positions interposing the three rows 123*a* and 123*b*, and including the plurality of communication holes 23*b* arranged in the direction of arrangement A. The two rows 123*d* located at the outermost position at each end of flow channel unit 4 may be configured similarly to the configuration of a row in which the plurality of holes are arranged alternately in the direction of arrangement A, and thus the number of holes in rows 123*d* may be about half of the number of holes in other rows 123*a* to 123*c*.

A surrounding groove 71 may be formed on an outermost periphery of the hole group, e.g., the plurality of communication holes 23*a* and 23*b*. Surrounding groove 71 may correspond to the shape of the hole group as shown in FIG. 6, and may be located on the surface of the base plate 25 on the side of the aperture plate 24.

An opening surrounding groove 72 may be formed on the outer periphery of each opening 5*c* of the base plate 23, along the outer peripheral shape of the opening 5*c* via the bonding margin of a predetermined width. Opening surrounding groove 72 may include an opening surrounding groove 72*a*, at a position closest to opening 5*c*, and opening surrounding grooves 72*b* and 72*c* may be enlarged from opening surrounding groove 72*a* in sequence. Connecting grooves 73 may be formed into a lattice pattern, and connected to surrounding groove 71, and opening surrounding groove 72*c* may be formed over the entire surface of the base plate 23 on the side of aperture plate 24, except for the areas inside surrounding groove 71 and opening surrounding groove 72. Connecting groove 73 may be in fluid communication with a through hole 58. Through holes 58 may be formed at a lower left portions of base plate 23 when base plate 23 is aligned as shown in FIG. 6. Therefore, surrounding groove 71, opening surrounding groove 72*c*, and connecting groove 73 may be in fluid communication with the atmosphere.

As shown in FIG. 6 and FIG. 7B, an inner groove 75 may be formed inside surrounding groove 71. Inner groove 75 may include a groove 75*a* extending along the outer peripheral shapes of respective communication holes 23*b*, which may be located in row 123*d*, and connecting the same, a groove 75*b* surrounding the plurality of communication holes 23*b*, which may be located in row 123*c*, a groove 75*c* surrounding communication holes 23*a* and 23*b* which may be located in a plurality of, e.g., three, sets of adjacent rows 123*a* and 123*b*, and a groove 75*d* for connecting groove 75*a*, groove 75*b*, and groove 75*c*. Inner groove 75 also may include third recesses, e.g., grooves 75*e* and 75*f*, formed between a plurality of, e.g., three, sets of adjacent rows 123*a* and 123*b*, a connecting groove 75*g* formed outside communication hole 23*b*, and located at the outermost position of the rows, for communicating the surrounding groove 71 and the groove 75*a*.

Inner groove 75 further may include a connecting groove 75*h* formed outside communication holes 23*b*, located at the outermost position of the rows, for connecting the surrounding groove 71 and the groove 75*b*. Grooves 75*a*, 75*b*, 75*c*, and 75*d* of inner groove 75 may be connected to surrounding groove 71, and may be in fluid communication with the atmosphere via the through hole 58. Grooves 71, 72, 73 and 75 may be formed on the base plate 23, and may be formed as recesses opening toward the aperture plate 24, e.g., opening on the surface of base plate 23 on the side of aperture plate 24 by a process, e.g., a half etching process, for releasing excessive adhesive agent generated when base plate 25 and aperture plate 24 are bonded.

When base plate 23 is positioned as shown in FIG. 7B, a plurality of grooves 75*e* may be arranged on the left side of row 123*a*, and a plurality of grooves 75*f* may be arranged on the right side of row 123*a*, along the direction of arrangement A. Grooves 75*e* and 75*f* may not be in fluid communication with other grooves on base plate 23. A groove formed between communication holes 23*a* and 23*b* for placing grooves 75*e* and 75*f* in fluid communication with adjacent groove 75*c* may reduce the bonding margin around communication holes 23*a* and 23*b*. When the bonding margin is too narrow, the individual ink flow channel 32 may independently come into fluid communication with the grooves, due to production inaccuracies, e.g., displacement at the time of laminating and bonding, which may allow ink to leak from the groove. In an embodiment, flow channel unit 4 may be upsized to prevent the bonding margin from becoming too narrow.

Figure 8:
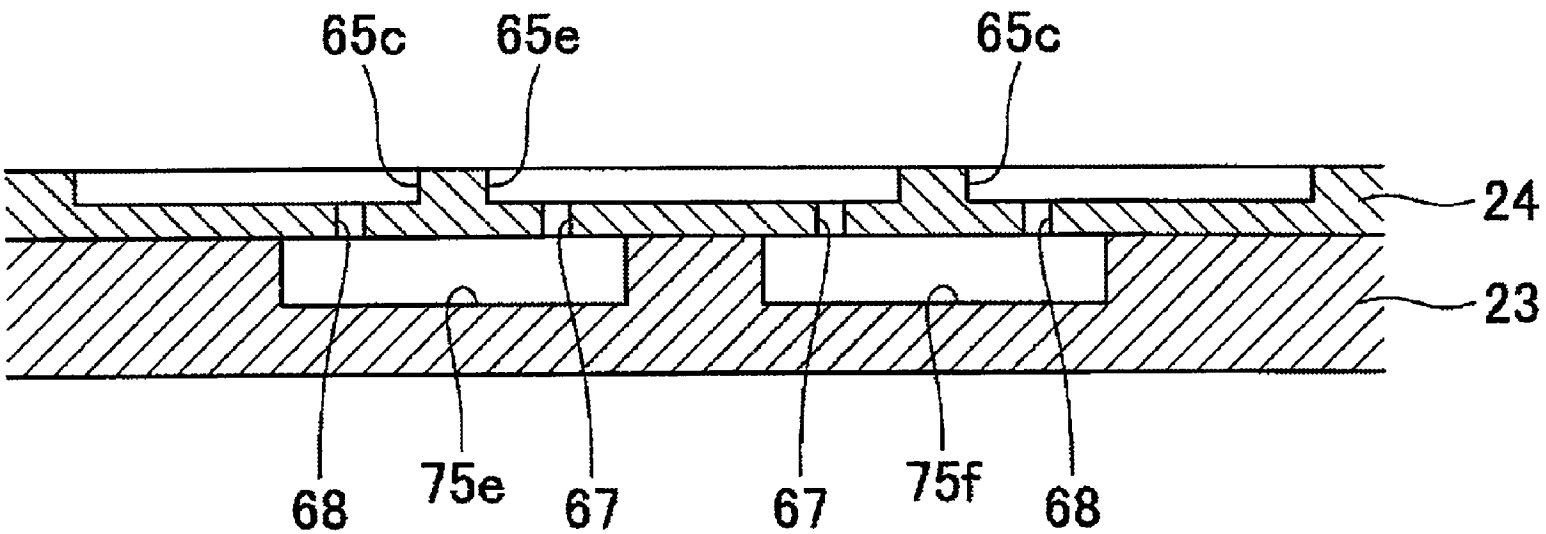
FIG. 8 is a partial cross-sectional view showing a state in which the base plate and the aperture plate are laminated, according to an embodiment of the invention.
Figure 9:
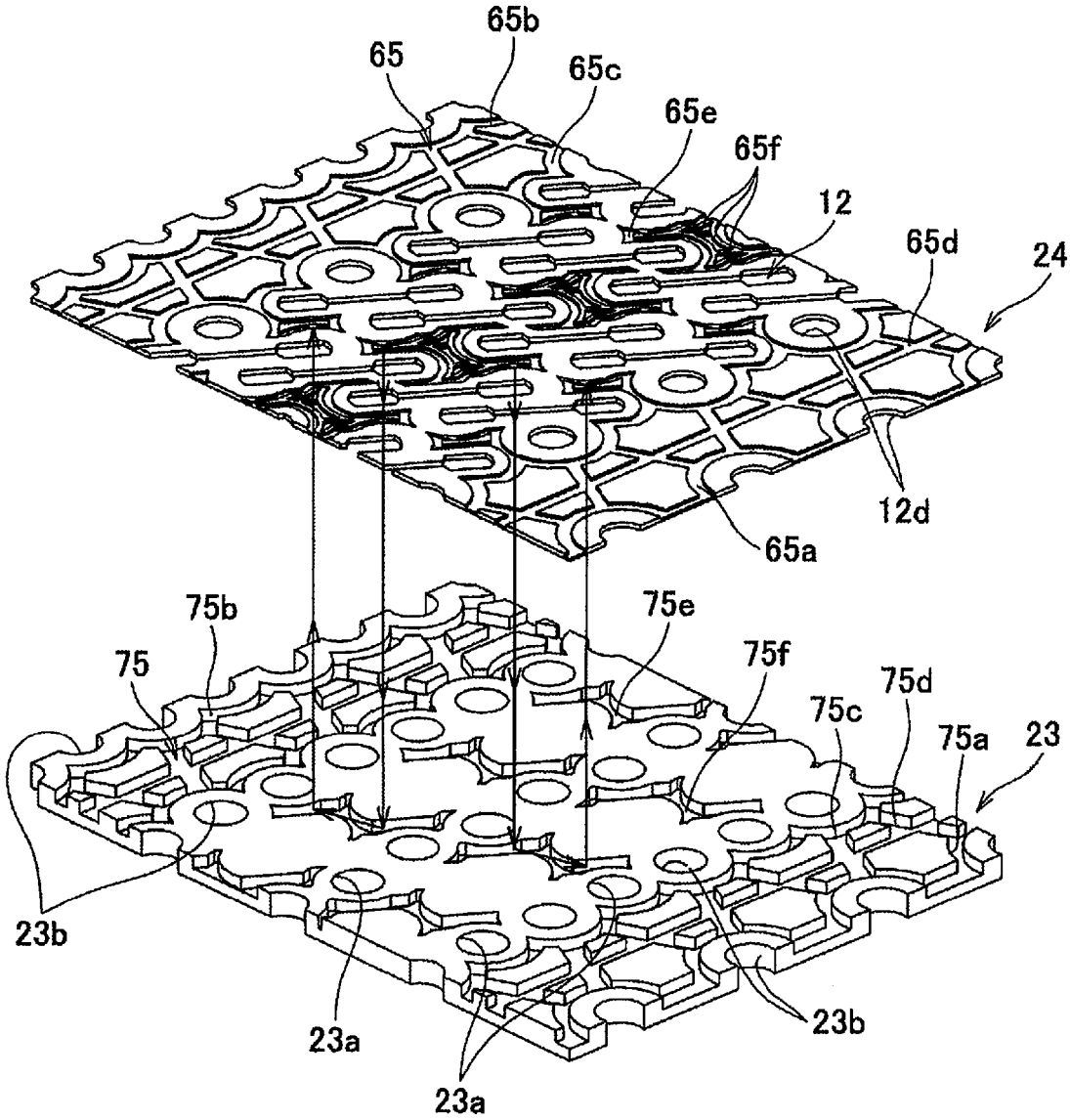
FIG. 9 is an exploded perspective view of the base plate and the aperture plate shown in FIG. 8.

As shown in FIG. 7B and FIG. 8, when the base plate 23 and the aperture plate 24 are laminated, grooves 75*e* and 75*f* may be positioned to oppose parts of grooves 65*e* and 65*c*, respectively. Aperture plate 24 may be formed with through holes 67, in areas of where groove 65*e* may oppose the grooves 75*e* and 75*f*, and through holes 69 may be formed in areas of the groove 65*c* opposing the grooves 75*e* and 75*f* As shown in FIG. 9, aperture plate 24 may be formed with the through holes 67 and through holes 68. Grooves 65*e* of aperture plate 24 may be in fluid communication with grooves 75*e* and 75*f* of base plate 23, via through holes 67, and grooves 75*e* and 75*f* may be in fluid communication with the grooves 65*c* of aperture plate 24 via through holes 68. Since groove 65*c* may be in fluid communication with the atmosphere, grooves 65*e* and grooves 75*e* and 75*f* also may be in fluid communication with the atmosphere.

Figure 10A:
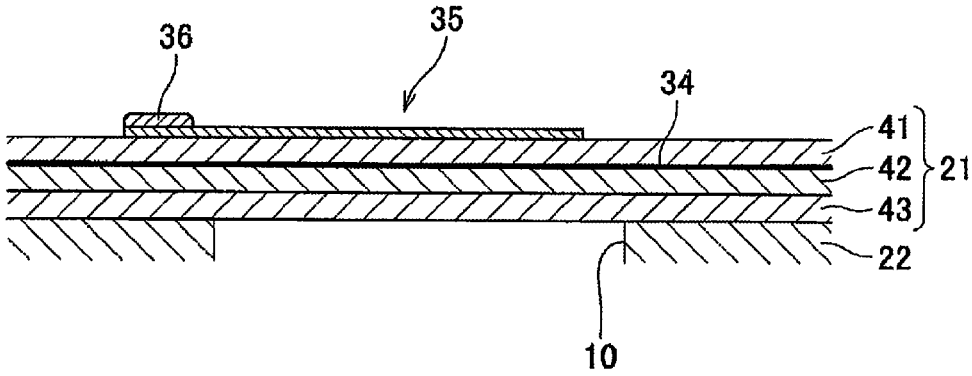
FIG. 10A is a partly enlarged cross-sectional view of an actuator unit and a pressure chamber according to an embodiment of the invention.
Figure 10B:
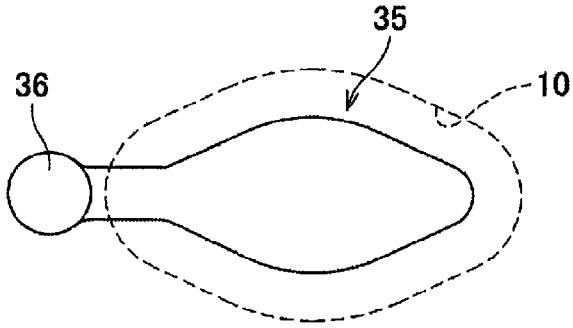
FIG. 10B is a plan view of the shape of the individual electrode bonded to the surface of the actuator unit according to an embodiment of the invention.

As shown in FIG. 10A, actuator unit 21, which may be laminated on cavity plate 22 as the uppermost layer of flow channel unit 4, may include a plurality of, e.g., three, piezoelectric sheets 41, 42, and 43, which may have substantially the same thickness, e.g., approximately 15 μm. Piezoelectric sheets 41 to 43 may be layered flat plates, e.g., a continuous flat plate layer, extending across one pressure chamber group 9, including all pressure chambers 10 comprising that pressure chamber group 9. Since piezoelectric sheets 41 to 43 may be formed as a continuous flat plate layer, high-density arrangement of individual electrodes 35 may be arranged on piezoelectric sheet 41, using any suitable technique, e.g., a screen printing technique. Piezoelectric sheets 41 to 43 may be formed of any appropriate ferroelectric material, e.g., lead zirconium titanate (PZT) based ceramic material. As shown in FIG. 10B, individual electrode 35 may have a thickness of approximately 1 μm, and may have a flat-plate, substantially diamond shape, similar to pressure chamber 10. One of the arcuate angle portions of individual electrode 35 may be extended, and a circular land 36 having a predetermined diameter, e.g., approximately 160 μm, may be provided at the distal end thereof.

A common electrode 34 may be arranged between piezoelectric sheet 41, which may be the uppermost layer, and piezoelectric sheet 42, which may be located one layer below piezoelectric sheet 41. Common electrode 34 may form substantially all of the upper surface of piezoelectric sheet 42, and may be grounded in a separate area. Actuator unit 21 may be configured as a unimorph type, and a number of individual actuators may be formed, each corresponding to the individual electrodes 35. Actuator unit 21 may receive a supply of drive signals from driver IC 52, upon reception of a discharge request. The respective actuators may be deformed to project toward pressure chamber 10, upon reception of a drive signal. At this time, the pressure of ink in pressure chamber 10 may be increased, and ink may be discharged from nozzles 8.

Groove 65*e*, grooves 75*e* and 75*f*, and groove 65*c* may be in fluid communication via through holes 67 and 68. Grooves 65*c*, 65*e*, 75*e*, and 75*f* may be in fluid communication with the atmosphere. When adhesive agent may be applied on the surface of base plate 23 where grooves 71, 72, 73, and 75 are formed, and the surface of aperture plate 24 where grooves 61, 62, 63, and 65 are formed, and when base plate 23, aperture plate 24, and supply plate 25 may be bonded and laminated, air existing in a space surrounded by groove 65*e* and supply plate 25, and a space surrounded by grooves 75*e* and 75*f* and aperture plate 24, may attempt to vent to the atmosphere. The venting air may reduce the ability of excessive adhesive agent to flow into apertures 12, and may redirect excessive adhesive agent into groove 65*e*, 75*e*, 75*f*. When groove 65*e* of aperture plate 24 are in fluid communication with the atmosphere via through holes 67 and 68, and grooves 75*e* and 75*f* are formed on adjacent base plate 23, it may not be necessary to form a groove extending inwardly from the surface of aperture plate 24, and part of the individual ink flow channel 32, may be formed on aperture plate 24 at a high density.

When grooves 75*e* and 75*f* may be arranged between rows 123*a* and rows 123*b*, the plurality of communication holes 23*a* and 23*b* may be in fluid communication with grooves 65*c* and 65*e* of aperture plate 24, via the through holes 67 and 68, a groove for placing grooves 75*e* and 75*f* with the atmosphere on the base plate 23 may be eliminated, and a part of the individual ink flow channel 32, e.g., the plurality of communication holes 23*a* and 23*b*, may be formed at a high density on base plate 23.

Figure 11:
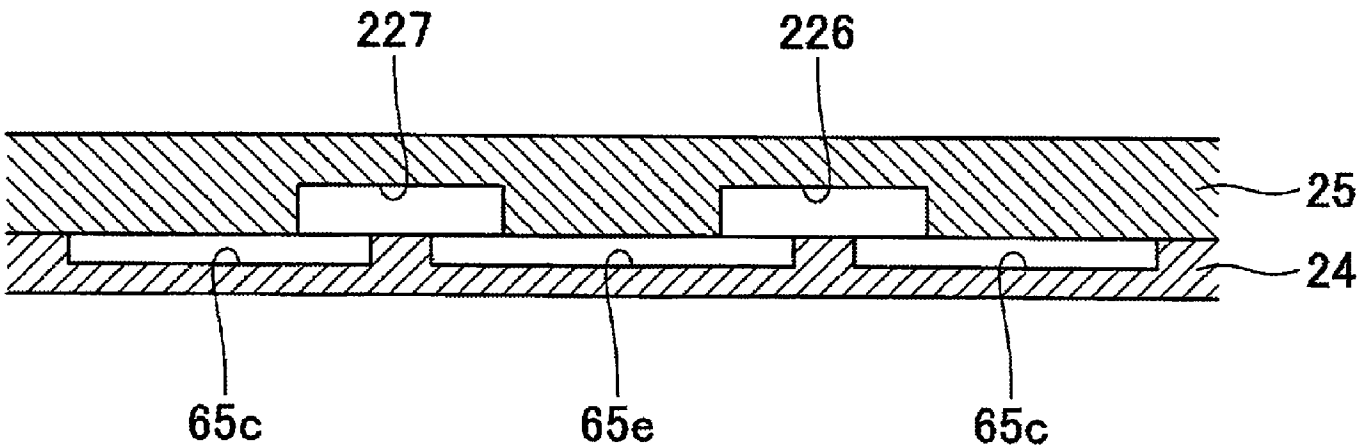
FIG. 11 is a partial cross-sectional view showing a state in which the aperture plate and a supply plate of an ink-jet head are laminated, according to another embodiment of the invention.

FIG. 11 shows an ink-jet head according to another embodiment of the invention. Parts and operation which are substantially the same as those in the first embodiment may be represented by the same reference numerals, and description will be omitted. In this embodiment through holes 67 and 68 may not be formed on aperture plate 24. Rather, grooves 65*c* and 65*e* may be placed in fluid communication with each other via recesses 226 and 227, located on supply plate 25.

As shown in FIG. 11, supply plate 25 may be formed with the recesses 226 and 227 opening on the side of the aperture plate 24. Recesses 226 and 227 may be formed by any suitable process, e.g., a half etching process. Recesses 226 and 227 may be formed so that when aperture plate 24 and supply plate 25 are laminated, recesses 226 and 227 may be located opposite parts of grooves 65*c* and 65*e* formed on aperture plate 24. In this manner, by the formation of recesses 226 and 227 on supply plate 25, grooves 65*c* and 65*e* may be in fluid communication with each other when aperture plate 24 and supply plate 25 are laminated. Therefore, air existing in a space surrounded by groove 65*e* and supply plate 25 may vent to the atmosphere, reducing the ability of excessive adhesive agent to flow into apertures 12, and redirecting excessive adhesive agent to flow the groove 65*e*.

While the invention has been described in connection with the above-described embodiment, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are considered exemplary only, with the true scope of the invention indicated by the following claims.

What is claimed is:

1. An ink-jet head comprising:

a flow channel unit comprising:

a plurality of laminated plates comprising a first plate, a second plate, and a third plate, wherein the plurality of laminated plates is configured to form a common ink chamber, a plurality of nozzles, and a plurality of pressure chambers therethrough; and a plurality of individual ink flow channels, each individual ink flow channel configured to extend from the common ink chamber to one of the plurality of nozzles via one of the plurality of pressure chambers, wherein the first plate comprises a plurality of apertures configured to place the common ink chamber and the pressure chambers in fluid communication, and wherein a surface of the first plate adjacent to the second plate, has a plurality of first recesses extending away from the second plate, the first recesses configured to be in fluid communication with the atmosphere, and a plurality of second recesses extending toward the third plate, being surrounded by the plurality of apertures, and wherein a surface of the third plate has a plurality of third recesses extending away from the first plate, and an opposite surface of the first plate has a plurality of openings therethrough, the plurality of openings being configured to place the first and second recesses in fluid communication with the third recesses of the third plate, wherein the first recesses and the second recesses extend only partially through the first plate.

2. The ink-jet head of claim 1, wherein the first recesses and second recesses are configured to release an adhesive agent for bonding the second plate to the surface of the first plate.

3. The ink-jet head of claim 1, wherein the third recesses are configured to release an adhesive agent for bonding the third plate to the opposite surface of the first plate.

4. The ink-jet head of claim 1, wherein the plurality of openings is configured to place the first recesses and the third recesses in fluid communication in areas where the first recesses and the third recesses oppose, and wherein the plurality of openings is configured to place the second recesses and the third recesses in fluid communication in areas where the second recesses and third recesses oppose.

5. The ink-jet head of claim 1, wherein the third plate further comprises a plurality of first flow channels configured to place each of the plurality of pressure chambers and the plurality of apertures in fluid communication, and a plurality of second flow channels, configured to place each of the plurality of pressure chambers and the plurality of nozzles in fluid communication, and wherein the plurality of first and second flow channels are arranged in a matrix pattern.

6. The ink-jet head of claim 5, wherein the plurality of first flow channels arranged in a first row of the matrix pattern are arranged along a first direction, and the plurality of first and second flow channels arranged in a second row of the matrix pattern are alternately arranged along the first direction, at a position interposing the first row, and the plurality of second flow channels arranged in a third row of the matrix pattern are arranged along the first direction at positions interposing the first and second rows.

7. The ink-jet head of claim 6, wherein the third recesses are arranged between the first row of the matrix pattern and the second row of the matrix pattern.

8. The ink-jet head of claim 1, wherein each of the plurality of apertures is configured to form a narrow portion of the individual ink flow channel that is narrower than a surrounding portion of the individual ink flow channel through which ink flows, and wherein the plurality of second recesses are surrounded by the narrow portions of the individual ink flow channels.

9. The ink-jet head of claim 1, wherein the respective recesses are configured to be formed by etching.

10. An ink-jet head comprising:

a flow channel unit comprising:

a plurality of laminated plates comprising a first plate and a second plate, wherein the plurality of laminated plates is configured to form a common ink chamber, a plurality of nozzles, and a plurality of pressure chambers therethrough; and a plurality of individual ink flow channels, each individual ink flow channel configured to extend from the common ink chamber to one of the plurality of nozzles via one of the plurality of pressure chambers, wherein the first plate comprises a plurality of apertures configured to place the common ink chambers and the pressure chambers in fluid communication, and wherein a surface of the first plate adjacent to the second plate comprises a plurality of first recesses extending away from the second plate, the first recesses configured to be in fluid communication with the atmosphere, and a plurality of second recesses extending away from the second plate, and surrounded by the plurality of apertures, and wherein a surface of the second plate comprises a plurality of third recesses extending away from the first plate, each of the plurality of third recesses opposing a portion of one of the plurality of first recesses and a portion of one of the plurality of fourth recesses, and wherein the third recesses are configured to be in fluid communication with the respective portions of each of the plurality of first and second recesses, wherein the first recesses and the second recesses extend only partially through the first plate.

11. The ink-jet head of claim 10, wherein the first recesses and second recesses are configured to release an adhesive agent for bonding the second plate to the surface of the first plate.

12. The ink-jet head of claim 10, wherein each of the plurality of apertures is configured to form a narrow portion of the individual ink flow channel that is narrower than a surrounding portion of the individual ink flow channel through which ink flows, and wherein the plurality of second recesses are surrounded by the narrow portions of the individual ink flow channels.

13. The ink-jet head of claim 10, wherein the respective recesses are configured to be formed by etching.

* * * * *